US010137691B2

(12) United States Patent
Moscato et al.

(10) Patent No.: US 10,137,691 B2
(45) Date of Patent: Nov. 27, 2018

(54) PRINTHEAD MAINTENANCE STATION AND METHOD OF OPERATING SAME

(71) Applicant: R.R. DONNELLEY & SONS COMPANY, Chicago, IL (US)

(72) Inventors: Anthony V. Moscato, North Tonawanda, NY (US); Jeffrey M. Sabin, West Seneca, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 15/195,566

(22) Filed: Jun. 28, 2016

(65) Prior Publication Data

US 2017/0253046 A1 Sep. 7, 2017

Related U.S. Application Data

(60) Provisional application No. 62/303,721, filed on Mar. 4, 2016.

(51) Int. Cl.
*B41J 2/165* (2006.01)
*B41J 2/175* (2006.01)

(52) U.S. Cl.
CPC ..... *B41J 2/16544* (2013.01); *B41J 2/1652* (2013.01); *B41J 2/16508* (2013.01); *B41J 2/16523* (2013.01); *B41J 2/16526* (2013.01); *B41J 2/16538* (2013.01); *B41J 2/16541* (2013.01); *B41J 2/16547* (2013.01); *B41J 2/17596* (2013.01)

(58) Field of Classification Search
None
See application file for complete search history.

(56) References Cited

U.S. PATENT DOCUMENTS

| | | | |
|---|---|---|---|
| 3,560,641 | A | 2/1971 | Taylor et al. |
| 3,647,138 | A | 3/1972 | Houser |
| 3,723,645 | A | 3/1973 | Takami et al. |
| 3,747,120 | A | 7/1973 | Stemme |

(Continued)

FOREIGN PATENT DOCUMENTS

| | | |
|---|---|---|
| EP | 0376345 | 7/1990 |
| EP | 585901 | 3/1994 |

(Continued)

OTHER PUBLICATIONS

International Preliminary Report on Patentability of International Application No. PCT/US2008/008114, dated Jan. 5, 2010, Applicant RR Donnelley (7 pages).

(Continued)

*Primary Examiner* — Alejandro Valencia
(74) *Attorney, Agent, or Firm* — McCracken & Gillen LLC

(57) ABSTRACT

A printhead maintenance station to cleaning a nozzle plate of a printhead and a method of operating the printhead maintenance station are disclosed. The printhead maintenance station includes a wiper bar, a wiper secured to the wiper bar, a wiper cleaning assembly, and an actuator. The wiper is stored in the wiper cleaning assembly when not in use. The controller operates the actuator to rotate the wiper bar to move the wiper from the wiper cleaning assembly to a wiping position, and causes relative movement of the printhead maintenance station and the print unit to wipe the nozzle plate with the wiper.

21 Claims, 10 Drawing Sheets

(56) References Cited

U.S. PATENT DOCUMENTS 3,891,121 A 6/1975 Stoneburner
3,974,508 A 8/1976 Blumenthal
4,042,937 A 8/1977 Perry et al.
4,050,078 A 9/1977 Isayama et al.
4,051,538 A 9/1977 Fox et al.
4,063,254 A 12/1977 Fox et al.
4,067,020 A 1/1978 Arway
4,116,626 A 9/1978 Varner
4,126,868 A 11/1978 Kirner
4,184,167 A 1/1980 Vandervalk
4,208,666 A 6/1980 Paranjpe
4,222,080 A 9/1980 Frazier
4,240,082 A 12/1980 Yu
4,250,512 A 2/1981 Kattner et al.
4,260,996 A 4/1981 Wittwer
4,296,418 A 10/1981 Yamazaki et al.
4,317,124 A 2/1982 Shirato et al.
4,330,787 A 5/1982 Sato et al.
4,362,572 A 12/1982 Wallace
4,403,229 A 9/1983 Barteck
4,410,897 A 10/1983 Moriguchi et al.
4,432,005 A 2/1984 Duffield et al.
4,494,124 A 1/1985 Piatt et al.
4,520,366 A 5/1985 Cragin, Jr.
4,528,996 A 7/1985 Jones
4,542,389 A 9/1985 Allen
4,571,600 A 2/1986 Hara
4,593,295 A 6/1986 Matsufuji et al.
4,598,303 A 7/1986 Peekema et al.
4,598,329 A 7/1986 Nelson
4,607,266 A 8/1986 DeBonte
4,623,897 A 11/1986 Brown et al.
4,628,329 A 12/1986 Regnault
4,694,307 A 9/1987 Toganoh et al.
4,706,099 A 11/1987 Suzuki
4,812,859 A 3/1989 Chan et al.
4,814,794 A 3/1989 Sato
4,825,229 A 4/1989 Matsumoto et al.
4,835,544 A 5/1989 Winterburn
4,881,132 A 11/1989 Lajos
5,087,805 A 2/1992 Silverschutz et al.
5,126,752 A 6/1992 Weinberg
5,126,766 A 6/1992 Terasawa et al.
5,182,578 A 1/1993 Goepel et al.
5,210,550 A 5/1993 Fisher et al.
5,211,493 A 5/1993 Stephenson et al.
5,272,491 A 12/1993 Asakawa et al.
5,369,429 A 11/1994 Erickson
5,382,969 A 1/1995 Mochizuki et al.
5,429,375 A 6/1995 Simon et al.
5,446,486 A 8/1995 Reis
5,504,510 A 4/1996 Miyakawa
5,512,924 A 4/1996 Takada et al.
5,543,827 A 8/1996 VanSteenkiste et al.
5,552,811 A 9/1996 Kurata et al.
5,559,539 A 9/1996 Vo et al.
5,570,117 A 10/1996 Karambelas et al.
5,585,825 A 12/1996 Kneezel et al.
5,598,198 A 1/1997 Taylor et al.
5,631,676 A 5/1997 Karz
5,646,666 A 7/1997 Cowger et al.
5,657,061 A 8/1997 Seccombe et al.
5,670,995 A 9/1997 Kupcho et al.
5,735,617 A 4/1998 Wirth
5,751,327 A 5/1998 De Cock et al.
5,765,481 A 6/1998 Tortora et al.
5,774,139 A 6/1998 Salzer et al.
5,774,141 A 6/1998 Cooper et al.
5,784,077 A 7/1998 Silverbrook
5,793,389 A 8/1998 Mitchell
5,796,411 A 8/1998 Cyman et al.
5,797,305 A 8/1998 Harrod et al.
5,812,151 A 9/1998 Kishine et al.
5,825,380 A 10/1998 Ichizawa et al.
5,877,788 A 3/1999 Haan et al.
5,877,793 A 3/1999 Erickson
5,903,293 A 5/1999 Nikkels et al.
5,923,347 A 7/1999 Wade
5,929,877 A 7/1999 Heetzer et al.
5,929,878 A 7/1999 Pelletier
5,949,438 A 9/1999 Cyman et al.
5,992,990 A 11/1999 Childers et al.
6,000,792 A 12/1999 Koizumi et al.
6,003,988 A 12/1999 McCann et al.
6,023,594 A 2/2000 Okiyama et al.
6,030,074 A 2/2000 Barinaga
6,033,061 A 3/2000 Niedermeyer et al.
6,089,693 A 7/2000 Drake et al.
6,120,142 A 9/2000 Eltgen et al.
6,164,768 A 12/2000 Murphy et al.
6,224,198 B1 5/2001 Cook et al.
6,234,597 B1 5/2001 Suzuki et al.
6,234,617 B1 5/2001 Niedermeyer et al.
6,267,518 B1 7/2001 Abe
6,273,103 B1 8/2001 Enz et al.
6,335,978 B1 1/2002 Moscato et al.
6,344,904 B1 2/2002 Mercer
6,347,858 B1 2/2002 Faisst, Jr. et al.
6,357,854 B1 3/2002 Igval et al.
6,364,451 B1 4/2002 Silverbrook
6,402,293 B1 6/2002 Sawicki
6,428,156 B1 8/2002 Waller et al.
6,435,637 B1 8/2002 Lyman
6,435,647 B2 8/2002 Faisst, Jr. et al.
RE37,874 E 10/2002 Pawlowski, Jr. et al.
6,457,802 B2 10/2002 Jackson
6,460,441 B1 10/2002 Harrod
6,478,402 B1 11/2002 Greive
6,530,644 B2 3/2003 Premnath et al.
6,532,025 B1 3/2003 Hiramatsu
6,536,863 B1 3/2003 Beauchamp et al.
6,547,370 B2 4/2003 Mantell et al.
6,550,889 B2 * 4/2003 Colombat ..... B41J 2/16552 347/28
6,575,554 B2 6/2003 Yoshinaga
6,575,556 B1 6/2003 Eremity et al.
6,585,350 B2 7/2003 Barinaga
6,601,951 B2 8/2003 Kuwabara et al.
6,604,813 B2 8/2003 Green
6,660,103 B1 12/2003 Johnston et al.
6,663,220 B2 12/2003 Suzuki et al.
6,663,304 B2 12/2003 Vives et al.
6,669,327 B1 12/2003 Harper
6,672,702 B2 1/2004 Sadasivan et al.
6,679,590 B2 1/2004 Enz
6,688,721 B1 2/2004 Serra
6,733,106 B1 5/2004 Leemhuis
6,802,588 B2 10/2004 Garbacz et al.
6,808,246 B2 10/2004 Long
6,811,249 B2 11/2004 DeVries et al.
6,820,960 B2 11/2004 Yun et al.
6,830,315 B2 12/2004 Silverbrook et al.
6,843,553 B2 1/2005 Ishii et al.
6,869,160 B2 3/2005 West et al.
6,880,912 B2 4/2005 Klausbruckner et al.
6,890,053 B2 5/2005 Myhill et al.
6,908,165 B2 6/2005 Pinard
6,916,132 B2 7/2005 Otsuka et al.
6,935,729 B2 8/2005 De Marco et al.
6,991,311 B2 1/2006 Su et al.
7,070,250 B2 7/2006 Lester et al.
7,083,273 B2 8/2006 Silverbrook
7,103,306 B2 9/2006 Shimizubata
7,118,189 B2 10/2006 Kuester et al.
7,178,900 B2 2/2007 Blouin et al.
7,212,319 B2 5/2007 Mercer
7,213,902 B2 5/2007 DeVivo et al.
7,222,955 B2 5/2007 Ohashi et al.
7,306,316 B2 12/2007 Doak
7,384,119 B2 6/2008 Karppinen et al.
7,401,888 B2 7/2008 Karppinen et al.
7,455,384 B2 11/2008 Tezuka
7,543,923 B2 6/2009 McNestry
7,576,875 B2 8/2009 Momose

(56) References Cited

U.S. PATENT DOCUMENTS

| | | | | |
|---|---|---|---|---|
| 7,717,549 | B2 | 5/2010 | Rademakers et al. | |
| 7,798,598 | B2 | 9/2010 | Horie | |
| 7,866,790 | B2 | 1/2011 | Miyazawa | |
| 7,874,636 | B2 | 1/2011 | Perrin et al. | |
| 7,918,530 | B2 | 4/2011 | Kanfoush et al. | |
| 8,091,860 | B2 | 1/2012 | Thompson et al. | |
| 8,141,971 | B2 | 3/2012 | Kondo | |
| 8,226,205 | B2 * | 7/2012 | Izawa | B41J 2/16547 347/33 |
| 8,251,488 | B2 | 8/2012 | Mealy et al. | |
| 8,801,144 | B2 * | 8/2014 | Tsuji | B41J 2/16535 347/33 |
| 8,926,060 | B2 | 1/2015 | Moscato et al. | |
| 9,216,581 | B2 | 12/2015 | Cyman, Jr. et al. | |
| 9,233,541 | B1 | 1/2016 | Cyr et al. | |
| 2005/0099469 | A1 | 5/2005 | Encrenaz et al. | |
| 2006/0274130 | A1 | 12/2006 | Self et al. | |
| 2008/0099508 | A1 | 5/2008 | Son et al. | |
| 2008/0286021 | A1 | 11/2008 | Asami | |
| 2012/0038706 | A1 * | 2/2012 | Izawa | B41J 2/16538 347/33 |
| 2014/0340447 | A1 | 11/2014 | Ito | |

FOREIGN PATENT DOCUMENTS

| | | |
|---|---|---|
| EP | 0749836 | 12/1996 |
| EP | 0 676 288 | 10/1998 |
| EP | 1 389 530 | 2/2004 |
| GB | 2280149 | 1/1995 |
| GB | 2 360 016 A | 9/2001 |
| JP | 62 218139 | 9/1987 |
| JP | 10-324038 | 12/1998 |
| WO | WO 96/35584 | 11/1996 |

OTHER PUBLICATIONS

International Search Report and Written Opinion of International Application No. PCT/US2008/008114, dated Sep. 8, 2008, Applicant RR Donnelley (8 pages).

Supplementary European Search Report for European Application No. EP 07 76 3393, dated Nov. 14, 2008 (9 pages).

International Preliminary Report on Patentability of International Application No. PCT/US2007/003239, dated Aug. 14, 2008, Applicant RR Donnelley et al (12 pages).

International Search Report and Written Opinion of International Application No. PCT/US2007/03239, dated Feb. 20, 2008, Applicant R.R. Donnelley (16 pages).

International Search Report and Written Opinion of International Application No. PCT/US2013/030047, dated Jul. 2, 2013, Applicant R.R. Donnelley & Sons Company (9 pages).

International Search Report and Written Opinion of International Application No. PCT/US2016/039858, dated Nov. 14, 2016, Applicant R.R. Donnelley & Sons Company (11 pages).

European Search Report for European Application No. EP 14154513, dated May 21, 2014 (6 pages).

* cited by examiner

PRINTHEAD MAINTENANCE STATION AND METHOD OF OPERATING SAME

CROSS REFERENCE TO RELATED APPLICATIONS

This application claims the benefit of U.S. Provisional Patent Application No. 62/303,721, filed Mar. 4, 2016. The entire contents of this application are incorporated herein by reference.

FIELD OF THE DISCLOSURE

The present disclosure relates generally to inkjet printing systems, and more particularly to a device for maintaining printheads of an inkjet printing system and a method of operating such a device.

BACKGROUND

Inkjet printing systems typically include one or more print units, and each print unit has one or more printheads. A controller controls the printhead to eject a fluid (such as ink or another composition) onto a medium. Each printhead includes a nozzle plate that includes a plurality of orifices (nozzles) through which ink from inside the printhead may be controllably ejected.

A printhead typically includes a fluid chamber in fluid communication with one or more of the nozzles. Pressure inside of the fluid chamber is increased relative to ambient air pressure to force a drop of fluid through the nozzle(s). One type of printhead uses a piezoelectric element that deforms a wall of the fluid chamber to reduce the volume thereof and thereby increase the pressure within the fluid chamber. Alternately, a heating element may be used to vaporize some of the fluid (or a constituent of the fluid such as a fluid carrier or a solvent) in the fluid chamber to form a bubble therein, which increases the pressure inside the fluid chamber. In either case a controller controls the current that is passed through the piezoelectric element to control the deformation thereof or controls the current through the heating element in turn to control the temperature thereof so that drops are formed when needed. Other types of inkjet technologies known in the art may be used in the printing systems described herein.

In a printing system, the printhead is secured to a mount and disposed such that the nozzles of the printhead are directed toward the medium. In some embodiments, more than one printhead may be secured to the mount in a one- or two-dimensional array. Further, some printing systems may include a plurality of mounts, wherein each mount has one or more printheads disposed therein in a one- or two-dimensional array. In such systems, the plurality of mounts may be disposed in the printing system in a one or two-dimensional array and the nozzles of the printheads in these mounts are directed toward the medium.

Dried ink, dust, paper fibers, and other debris can collect on a nozzle plate or in one or more nozzles of the printhead and prevent proper ejection of ink from such nozzles. The controller of a printing system can undertake periodic cleaning cycles during which ink is purged from the nozzle(s) to release any debris in or near such nozzle(s). The purged ink and/or debris must be removed from the nozzle plate in the vicinity of the nozzles, for example, by wiping, so that such purged ink and/or debris does not collect on the nozzle plate and dry to create further debris that will later interfere with ejection of ink from nozzles of the printhead.

SUMMARY

According to one aspect, a printhead maintenance station for cleaning a nozzle plate of a print unit that is movable parallel to a first axis and a second axis includes a wiper bar having a wiper secured thereto, a wiper cleaning assembly, and an actuator. The wiper is movable from a stored position in which the wiper is stored in the wiper cleaning assembly and a wiping position spaced apart from the stored position. A controller is adapted to move a print medium, the printhead maintenance station, and the print unit parallel to the first axis. In addition, the printhead maintenance station is adapted to remain stationary when the print unit moves parallel to the second axis and, when not in use, the wiper is disposed at the stored position. During a maintenance cycle, the controller is adapted to operate the actuator to move the wiper bar to move the wiper from the stored position to the wiping position, and cause relative movement of the printhead maintenance station and the print unit to wipe the nozzle plate with the wiper.

According to another aspect, a method of operating a print head maintenance station to clean a nozzle plate of a print unit that is movable parallel to a first axis and a second axis, wherein the printhead maintenance station includes a wiper bar, a wiper secured to the wiper bar, and a wiper cleaning assembly, wherein wiper is movable from a stored position in which the wiper is stored in the wiper cleaning assembly and a wiping position spaced apart from the stored position, includes the steps of disposing the wiper at the stored position and operating an actuator to move the wiper bar to move the wiper from the stored position to the wiping position. The method includes the further step of moving a print medium, the printhead maintenance station, and the print unit parallel to the first axis. In addition, the method includes the steps of keeping the printhead maintenance station stationary when the print unit moves parallel to the second axis and moving the print unit relative to the printhead maintenance station thereby wiping the nozzle plate with the wiper.

DETAILED DESCRIPTION

Figure 1:
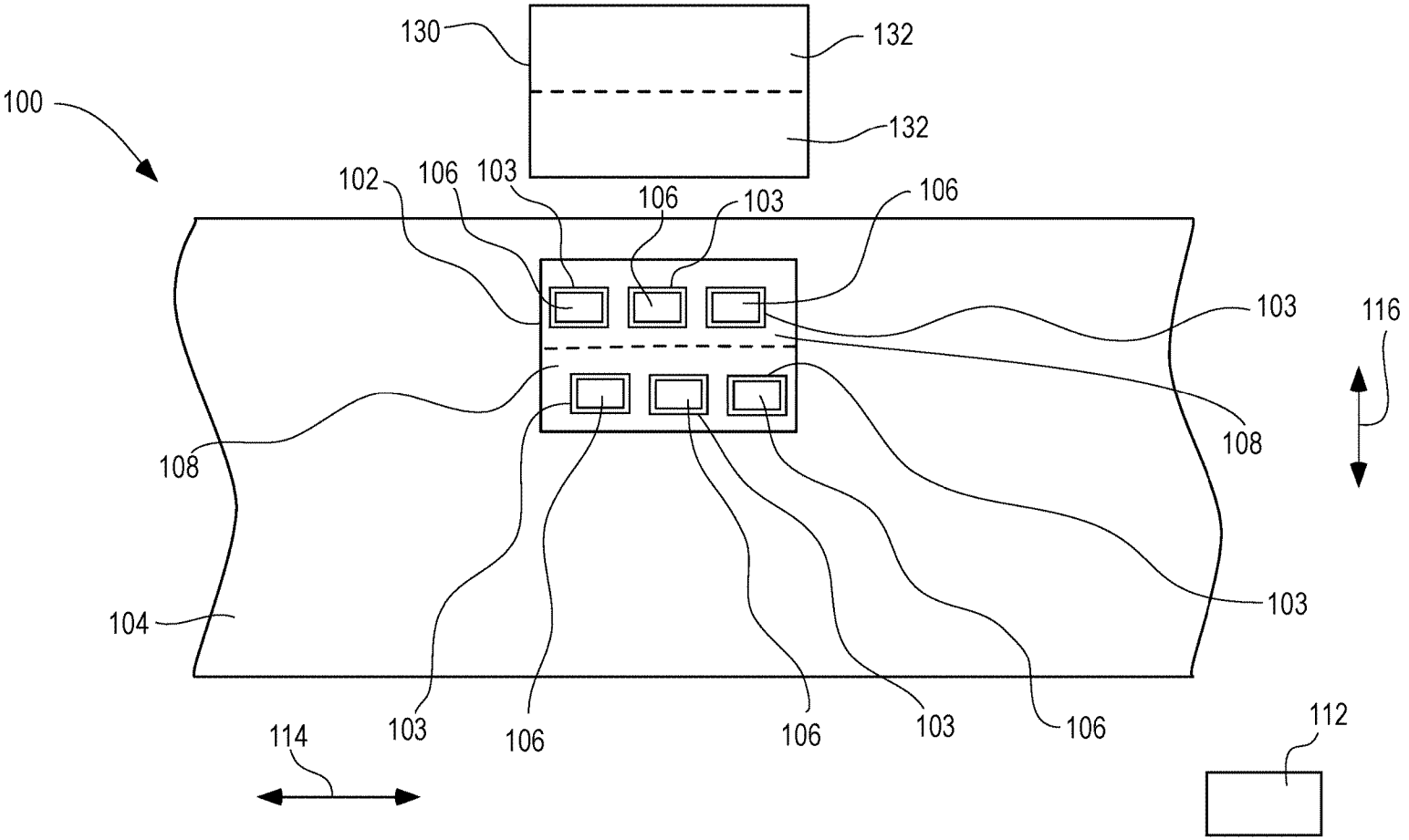
FIG. 1 is a plan view of a printing system.

Referring to FIG. 1, a printing system 100 includes a print unit 102 arranged to eject ink toward a medium 104. The print unit 102 comprises at least one mount 103 and one or more printheads 106 may be disposed in each mount 103. The printheads 106 of the print unit 102 may be arranged in one or more rows 108. In some embodiments, each row 108 may have one printhead 106. In other embodiments, each row 108 may have a plurality of printheads 106. In some cases, the one or more printheads 106 may be arranged in a one-dimensional array or a two-dimensional array. Further, in some cases all the rows 108 of the print unit 102 may have an identical number or printheads 106. Alternately, the number of printheads 106 in the rows 108 of the print unit 102 may vary from row to row.

In some embodiments, each printhead 106 of the print unit 102 may print a particular color of ink. As may be apparent to one of skill in the art, the print unit 102 may include, for example, four printheads 106 that print cyan, magenta, yellow, and black ink to form four-color images on the medium 104. The print unit 102 may also include one or more other printheads 106 that print a custom color ink, a white ink, a metallic ink, and/or the like. Each printhead 106 includes a nozzle plate having a plurality of nozzles (orifices) and during operation ink or another liquid may be ejected through such nozzles and deposited on the medium 104. The medium 104 may be coated or uncoated paper, plastic, polyethylene, a metal, and/or any substrate on which ink or another material ejected by the printhead 106 may be deposited.

The printing system 100 includes a controller 112 to coordinate relative movement between the print unit 102 and the medium 104, operation of the printheads 106 to print an image on the medium 104, and maintenance of the printheads 106. In some embodiments, during printing, the medium 104 may be transported in a direction parallel to a first axis 114 while the print unit 102 is transported in a direction parallel to a second axis 116 perpendicular to the first axis 114. In other embodiments, the print unit 102 may be transported in directions parallel to both the first axis 114 and the second axis 116, while the medium 104 is transported parallel to the first axis 114.

Figure 1A:
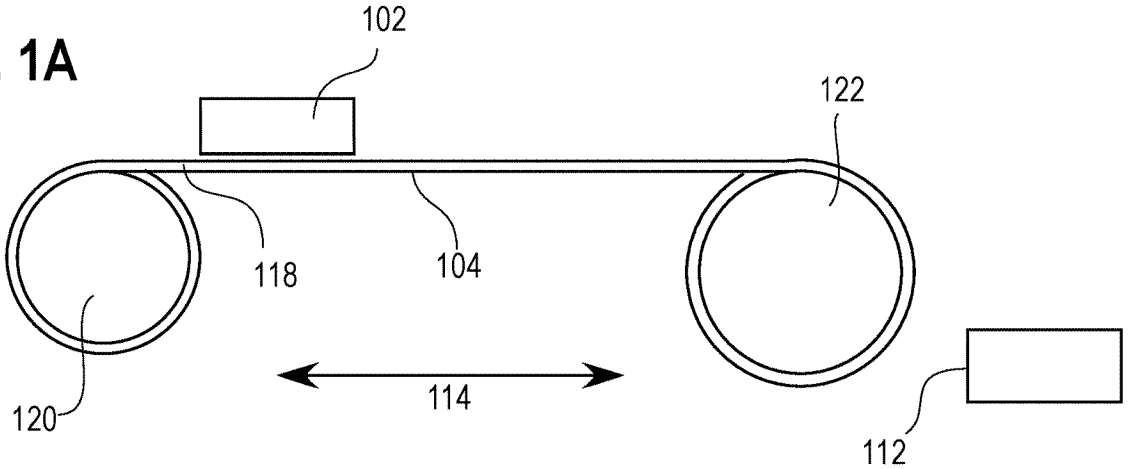
FIGS. 1A and 1B are diagrammatic side elevational views of embodiments of the printing system of FIG. 1.

Referring to FIG. 1A, in one embodiment, the medium 104 is a web 118 of material to be printed on and supplied from a supply roller 120. In such embodiments, the controller 112 operates the supply roller 120 and/or a take up roller 122 to transport the medium 104 past the print unit 102. In another embodiment, medium 104 may be processed by a finishing station that cuts and/or folds the printed web 118 to produce deliverable products. In either embodiment, the controller 112 may control one or more motors (not shown) coupled to the supply roller 120 and/or the take up roller 122, and/or may control the finishing station to synchronize movement of the web 118 with operation of the print unit 102.

Figure 1B:
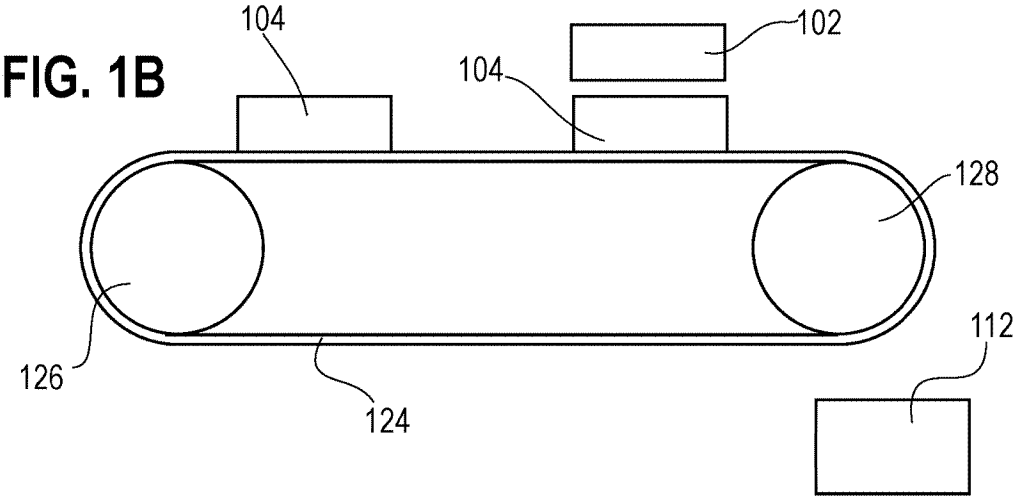

Referring to FIG. 1B, in yet another embodiment, the medium 104 is placed on a carrier 124, and the carrier 124 and the medium 104 is transported relative to the print unit 102. The carrier 124 may be, for example, a belt driven by rollers 126 and 128. The controller 112 may control one or more motors coupled to the rollers 126 and 128 to synchronize the movement of the carrier 124 with the operation of the print unit 102.

Referring once again to FIG. 1, the printing system 100 also includes a printhead maintenance station 130. In some embodiments, the printhead maintenance station 130 includes a maintenance section 132 for each row 108 of printheads 106 that comprises the print unit 102. The controller 112 initiates a maintenance cycle to clean the nozzle plates of the printheads 106 of the print unit 102. During the maintenance cycle, ink is purged through the nozzles of the printheads 106 to release dried ink and other debris therefrom, and the nozzle plate of each printhead 106 is wiped of any ink and/or debris thereon.

In some embodiments, the controller 112 initiates the maintenance cycle after the print unit 102 has been operated for a predetermined period of time since the last maintenance cycle. In other embodiments, if the medium 104 is a web 118 (FIG. 1A), the controller 112 may detect a paper splice and coordinate the maintenance cycle when the paper splice is transported past the print unit 102. In still other embodiments, the controller 112 may coordinate the maintenance cycle with a roll change. In some cases, if the carrier 124 (FIG. 1B) transports the media 104, the controller 112 may initiate a cleaning cycle after predetermined quantity of discrete media 104 has been printed. More generally, the controller 112 may initiate maintenance on a periodic or aperiodic basis, or a combination of the two (e.g., a maintenance cycle may be initiated every day but could be initiated sooner if a particular number of pages are printed before the daily cleaning is initiated.)

In some cases, the controller 112 may stop the transport of the web 118 or the carrier 124 when the maintenance cycle is initiated. In other cases, the movement of the web 118 or the carrier 124 is uninterrupted while the maintenance cycle is undertaken, for example, if the maintenance cycle coincides with a roll change or a paper splice, or when a gap is present between discrete media 104 placed on the carrier 124. It should be apparent that the maintenance cycle could be undertaken at any time the printheads 106 are not being used to print, with or without stopping the transport of the medium 104, the web 118, and/or the carrier 124.

The printhead maintenance station 130 is disposed in the printing system 100 such that the printhead maintenance station 130 does not interfere with transport of the web 118 and/or the carrier 124. In some embodiments, the printhead maintenance station 130 remains stationary while the print medium 104 and the print unit 102 are transported relative to one another during printing.

In other embodiments, the printhead maintenance station 130 moves in synchrony with the print unit 102 when the print unit 102 moves in the direction parallel to the first axis 114 and remains stationary when the print unit 102 moves in the direction parallel to the second axis 116. In such embodiments, when the maintenance cycle is initiated, the print unit 102 needs to move only in the direction parallel to the second axis 116 to be in position for maintenance. In some embodiments, when a maintenance cycle is initiated the print unit 102 may remain stationary relative to the axes 114 and 116 and the printhead maintenance station 130 may move toward the print unit 102.

Referring to FIGS. 2A-2G illustrate a printing system 100 having two printheads 106*a*,106*b*, it being understood that the printing system 100 may include a different number of printheads 106. In the illustrated embodiment of the printing system 100, the printhead maintenance station 130 includes catch troughs 150 and wipers 152*a*,152*b* associated with the printheads 106*a*,106*b*, respectively, of the print unit 102. When not being used, the wipers 152*a*, 152*b* may be stored in a retracted (or cleaning and/or storage) position in a housing 154 of the printhead maintenance station 130.

When the print unit 102 is printing (FIG. 2A), the print unit 102 is positioned over the medium 104 such that a nozzle plates 156*a*,156*b* of each printhead 106*a*,106*b*, respectively, faces the medium 104.

Figure 2A:
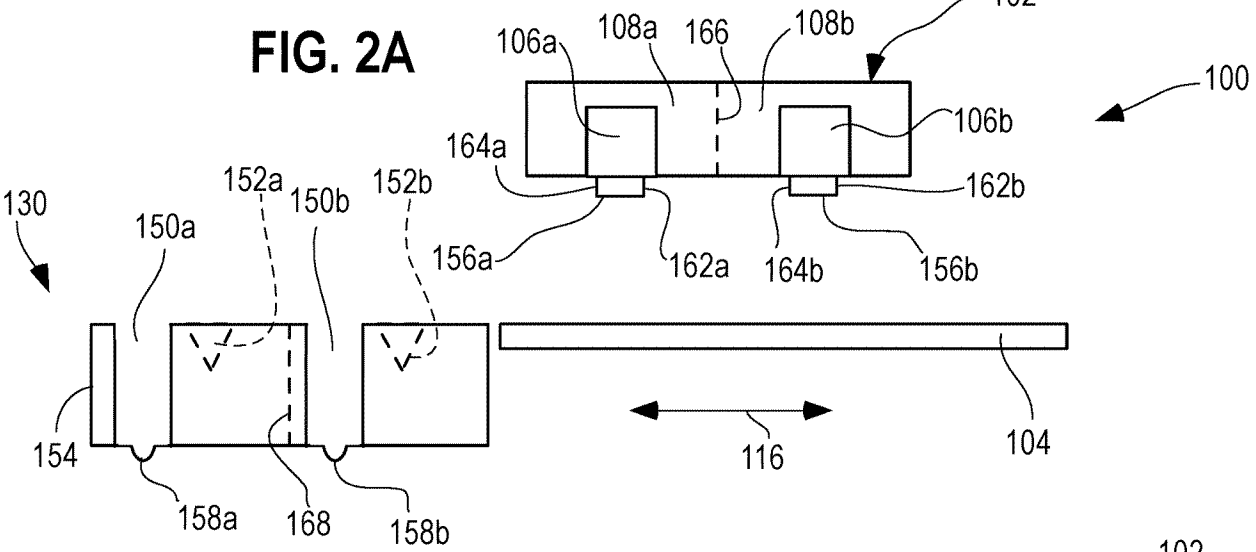
FIGS. 2A-2G are diagrammatic end elevational views illustrating the operation of a printhead maintenance station of the printing system of FIG. 1.
Figure 2B:
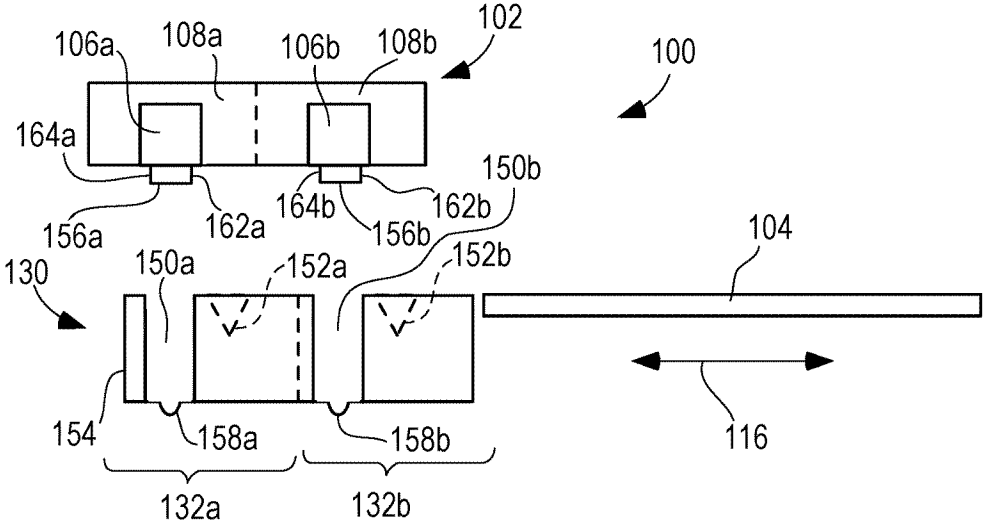

When a maintenance cycle is initiated, the controller 112 causes the print unit 102 to move relative to the printhead maintenance station 130 until the print unit 102 is at a first maintenance position at which the nozzle plate 156 of each printhead 106 is aligned with the catch trough 150 associated with such printhead 106 (FIG. 2A). Thereafter, the controller 112 causes each printhead 106 to purge ink from the nozzles thereof. In some embodiments, the controller 112 may actuate a piezoelectric element or the heater inside the printhead 106 to cause ink to be purged. In other embodiments, the controller 112 may drive a pump (not shown) in fluid communication with an ink supply line (not shown) coupled to the printhead 106 to increase the pressure at which ink is delivered to the printhead 106 and thereby cause ink to be purged from the nozzles thereof into the catch trough 150. Ink that is purged into the catch trough 150 flows through a drain 158 and a fluid line (not shown in FIGS. 2A-2G) coupled to the drain 158 and into a fluid recovery tank (also not shown in FIGS. 2A-2G).

Figure 2C:
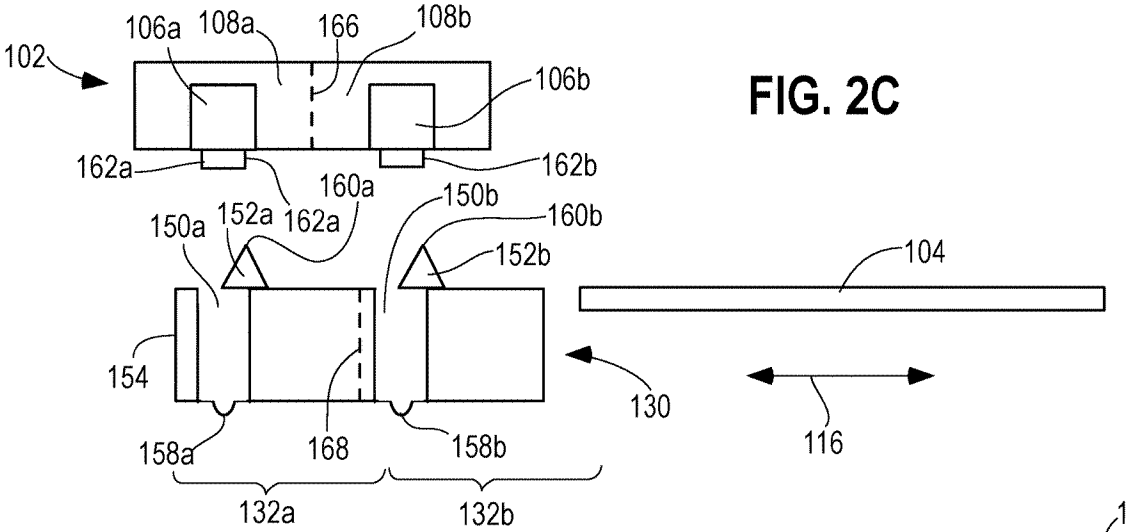

After the ink has been purged, the wipers 152 are moved from the retracted position (FIGS. 2A and 2B) to an extended wiping position (FIG. 2C). In the illustrated embodiment, the printhead maintenance station 130 is configured so that when the wipers 152*a*,152*b* are moved to the wiping position, a wiping portion 160*a*,160*b* of the wipers 152*a*,152*b*, respectively, are initially aligned with first edges 162*a*,162*b* of the nozzle plates 156*a*,156*b* of the printheads 106*a*,106*b* associated with the wipers 152*a*,152*b*, respectively.

Figure 2D:
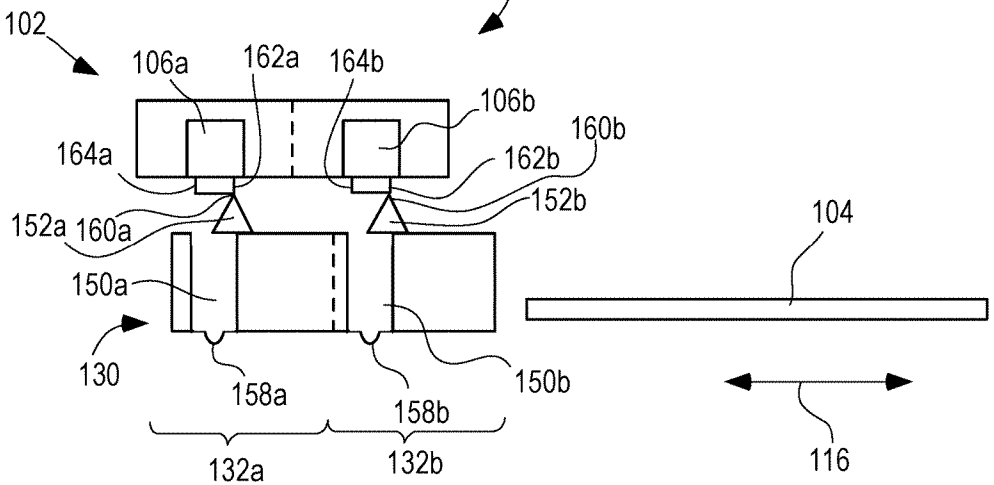
Figure 2F:
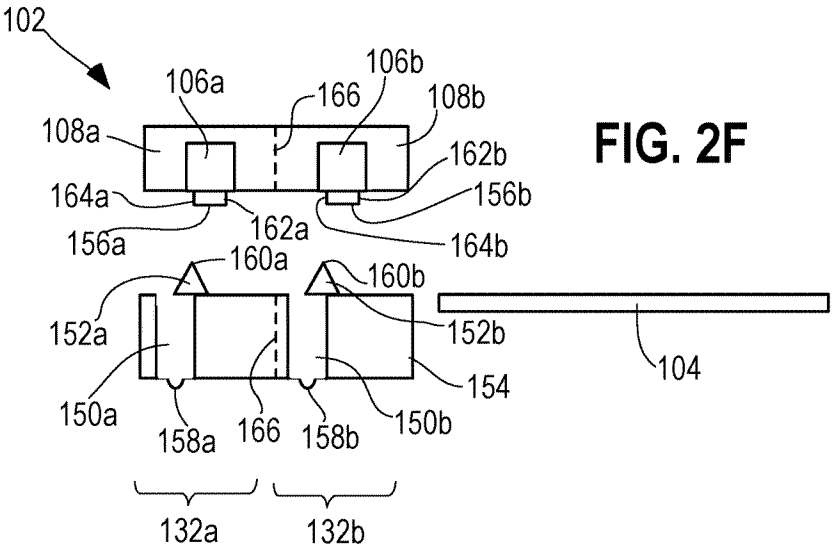

Thereafter, the print unit 102 and the printhead maintenance station 130 are moved relative to one another until the wiping portion 160 of each wiper 152 contacts the first edge 162 of the nozzle plate 156 of the printhead 106 associated with such wiper 152 (FIG. 2D). In some embodiments, the printhead maintenance station 130 is moved toward the print unit 102, while the print unit 102 remains stationary. In other embodiments, both the printhead maintenance station 130 and the print unit 102 are moved toward one another. In still other embodiments, the printhead maintenance station 130 remains stationary and the print unit 102 is moved toward the printhead maintenance station 130.

Figure 2E:
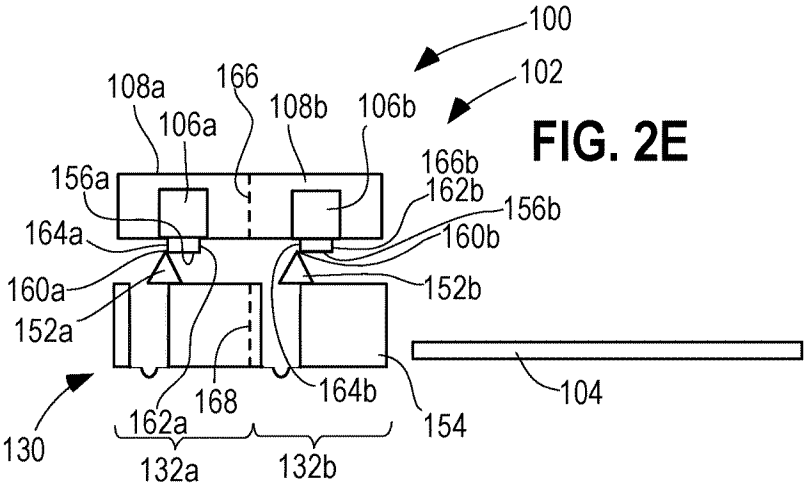

The print unit 102 and the printhead maintenance station 130 are then moved relative to one another such that the wiping portion 160 of each wiper 152 remains in contact with and wipes the nozzle plate 156 of the printhead 106 associated with the wiper. Such movement is undertaken until the print unit 102 reaches a second maintenance position at which the wiping portion 160 reaches a second edge 164 of the nozzle plate 156 (FIG. 2E). In the illustrated embodiment, when the print unit 102 is disposed at the second maintenance position, the print unit 102 is positioned relative to the print maintenance station 130 such that a central axis 166 of the print unit 102 is aligned with a central axis 168 of the printhead maintenance station 130, as seen in FIG. 2E. The wipers 152 may then be retracted into the housing 154 for cleaning and storage as described below (FIG. 2G).

It should be apparent that the print unit 102 and the printhead maintenance state 130 may be moved relatively to one another repeatedly (for example, back and forth) between the first maintenance position and the second maintenance position during a maintenance cycle before the wipers are retracted into the housing 154. Such repeated movement may be undertaken, for example, to more thoroughly wipe the nozzle plates 156 of the printhead 106 during the maintenance cycle.

If additional printing is to be undertaken, the controller 112 may cause the print unit 102 to return to the printing position shown in FIG. 2A to continue printing.

Figure 2G:
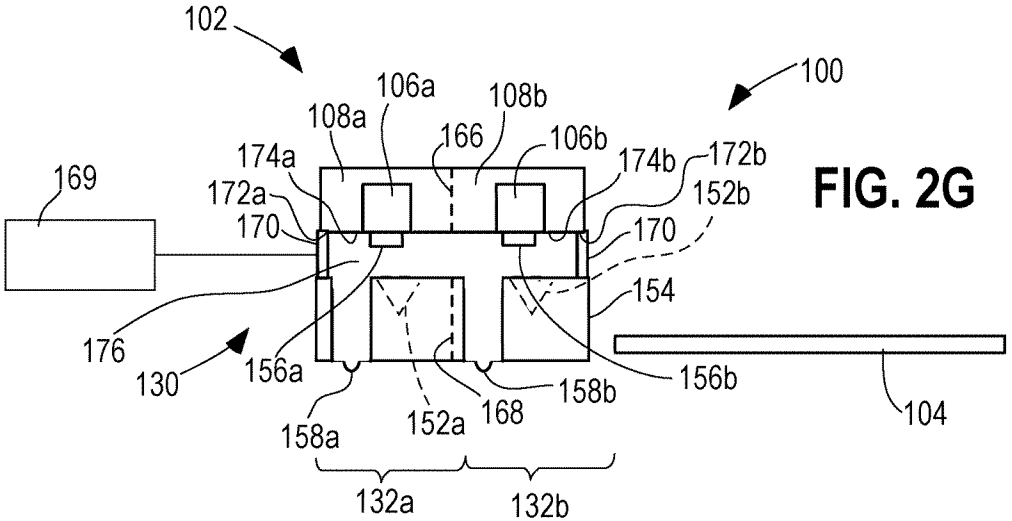

Alternately, as seen in FIG. 2G, the print unit 102 may remain in the second maintenance position and the controller 112 may actuate a pump 169 to inflate an inflatable gasket 170 disposed about the periphery of the printhead maintenance station 130. The inflatable gasket 170 is secured to the printhead maintenance station 130 by, for example, and adhesive, and is carried by the printhead maintenance station 130. The inflatable gasket 170 is inflated until a top portion 172 of the inflatable gasket 170 is pressed against an outer surface 174 of the print unit 102. When inflated in this manner, the inflatable gasket 170 provides a seal between the print unit 102 and the printhead maintenance station 130 that isolates a space 176 therebetween from the ambient environment in which the printing system 100 is disposed. (FIG. 2G) Inasmuch as the nozzle plates 156 of the printheads 106 of the print unit 102 are disposed in the volume 176, such structures are also protected from debris or pollutants in the ambient environment, and/or changes in the temperature and/or humidity in the ambient environment.

Figure 3:
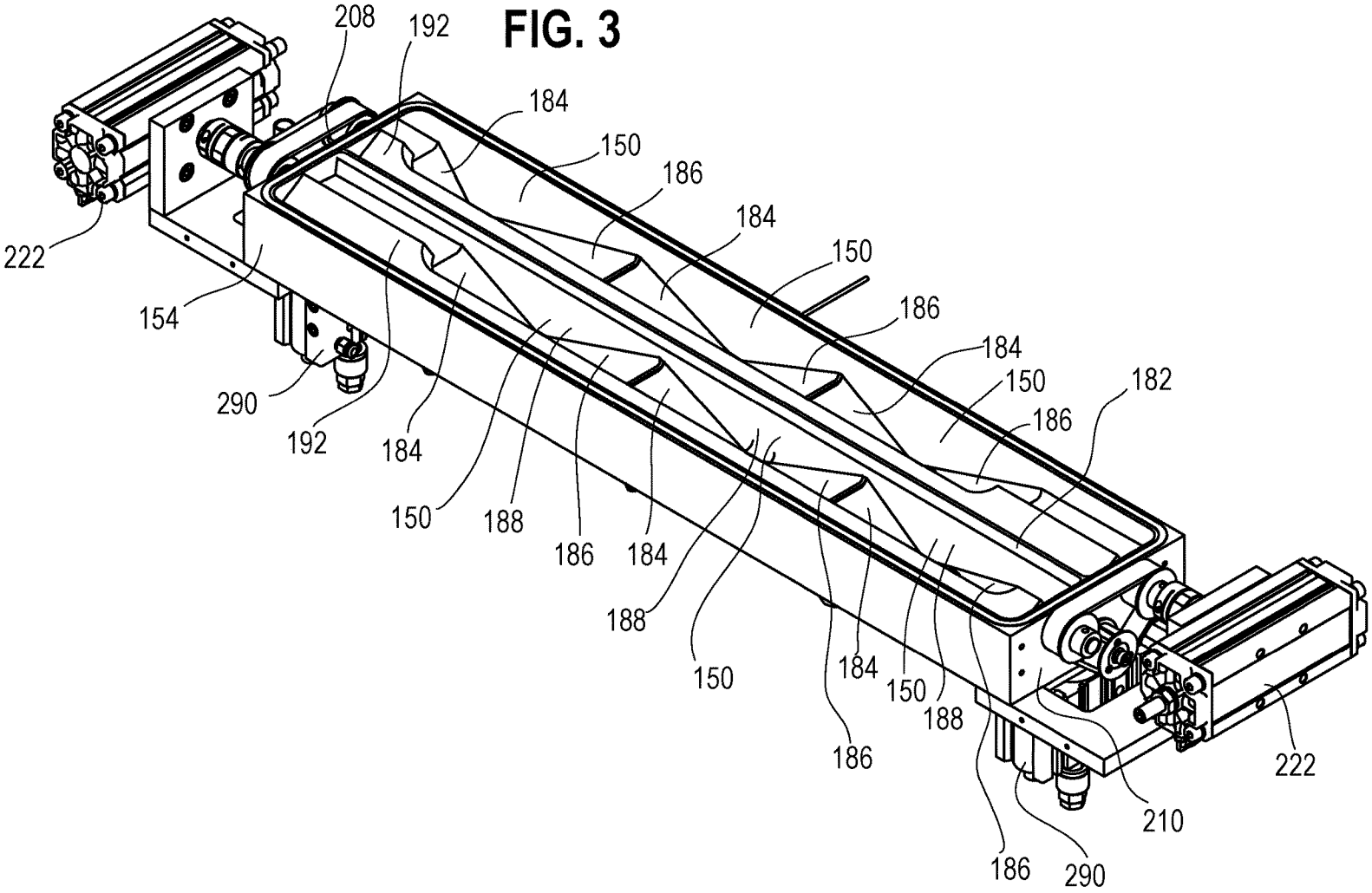
FIG. 3 is an isometric view of the printhead maintenance station of FIGS. 2A-2G with wipers shown in a retracted position.

Referring to FIG. 3, the maintenance sections 132 of the printhead maintenance station 130 are separated from one another by an interior sidewall 182 of the housing 154. In one embodiment, the interior sidewall 182 extends a length of the housing 154 of the printhead maintenance station 130. Each catch trough 150 of the printhead maintenance station 130 includes a sloping first sidewall 184, a sloping second sidewall 186, a substantially upright third sidewall 188, and a substantially upright fourth sidewall 190. The sloping first and second sidewalls, 184 and 186, slope toward the drain 158 (see FIG. 4A) disposed in the bottom of each catch trough 150. Such sidewalls are configured so that any purged ink deposited onto either the first sloping sidewall 184 or the sloping second sidewall 186 will flow toward the drain 158. In some embodiments, one of the upright sidewalls 188 or 190 of one or more of the catch troughs 150 may be integral with the interior sidewall 182 of the housing 154 that separates the maintenance sections 132 of the printhead maintenance station 130.

Figure 4A:
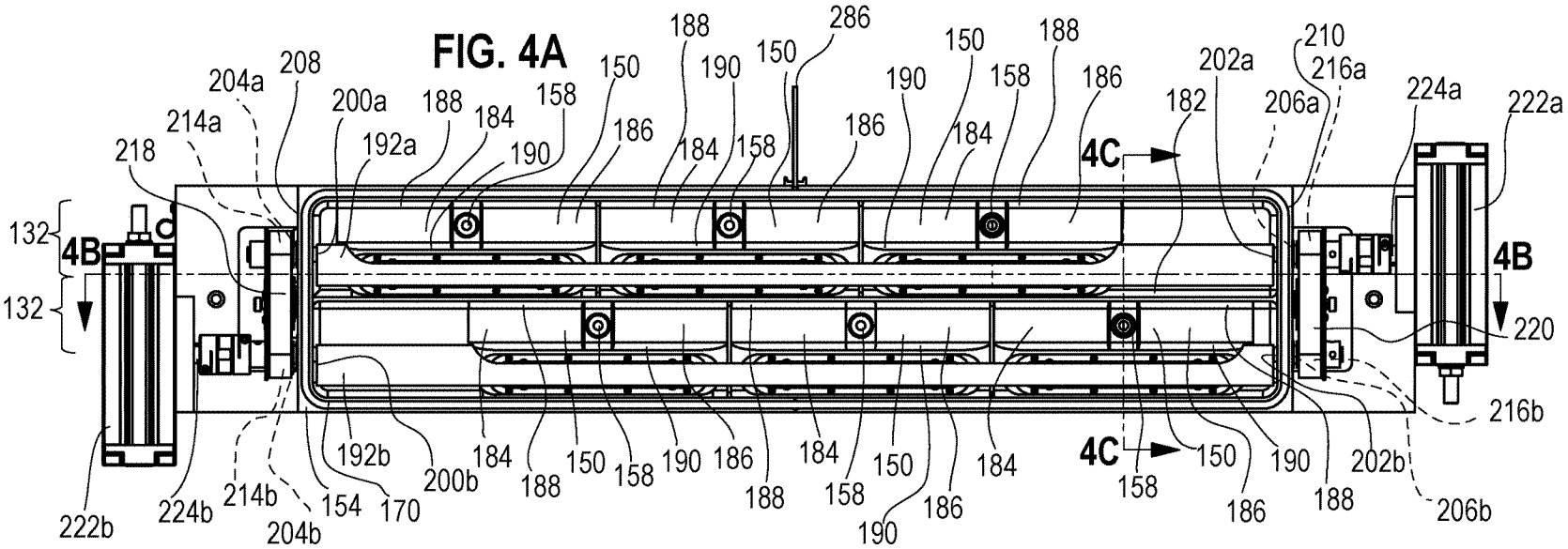
FIG. 4A is a plan view of the printhead maintenance station of FIGS. 2A-2G.
Figure 4B:
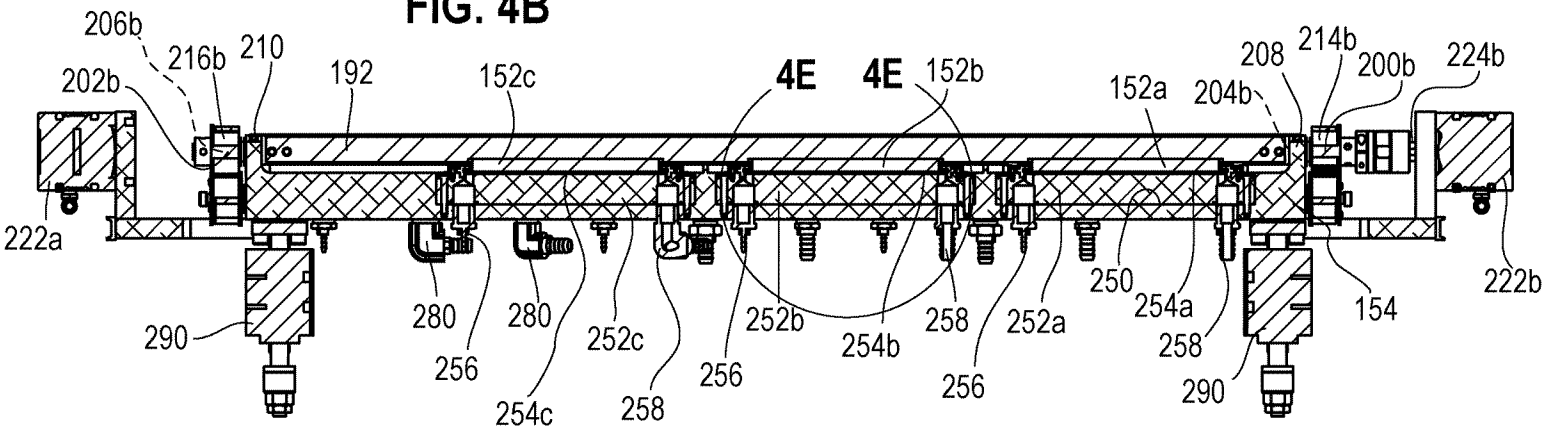
FIG. 4B is a sectional view taken generally along the lines 4B-4B of FIG. 4A.
Figure 4C:
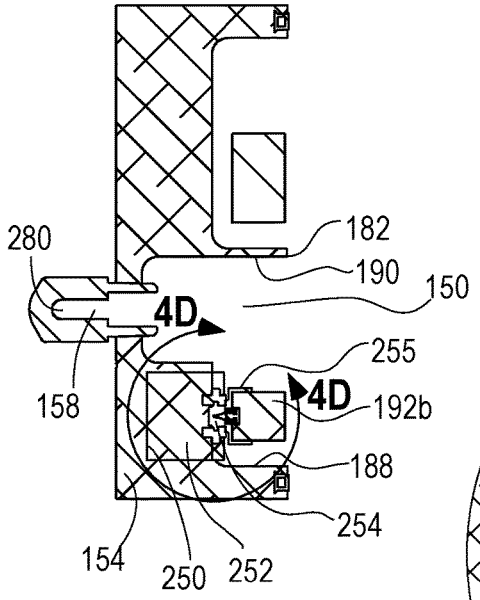
FIG. 4C is a sectional view taken generally along the lines 4C-4C of FIG. 4A.

FIGS. 4A and 4B show the printhead maintenance station 130 with the wipers 152 in the retracted positions as described above in connection with FIGS. 2A, 2B and 2G. FIGS. 4F and 4G shown the printhead maintenance station 130 with the wipers 152 in the wiping position as described in connection with FIGS. 2C through 2F.

Figure 4D:
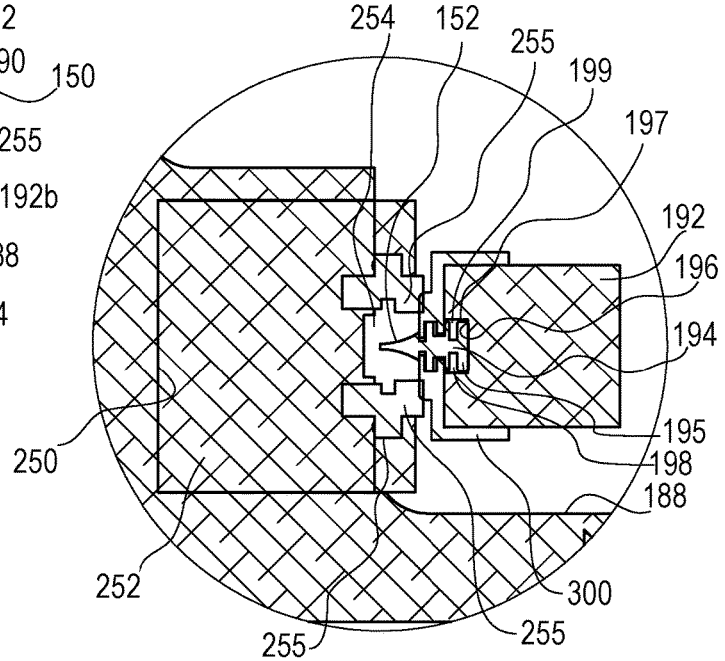
FIG. 4D is an enlarged, fragmentary view of the region indicated by the line 4D-4D of FIG. 4C.
Figure 4E:
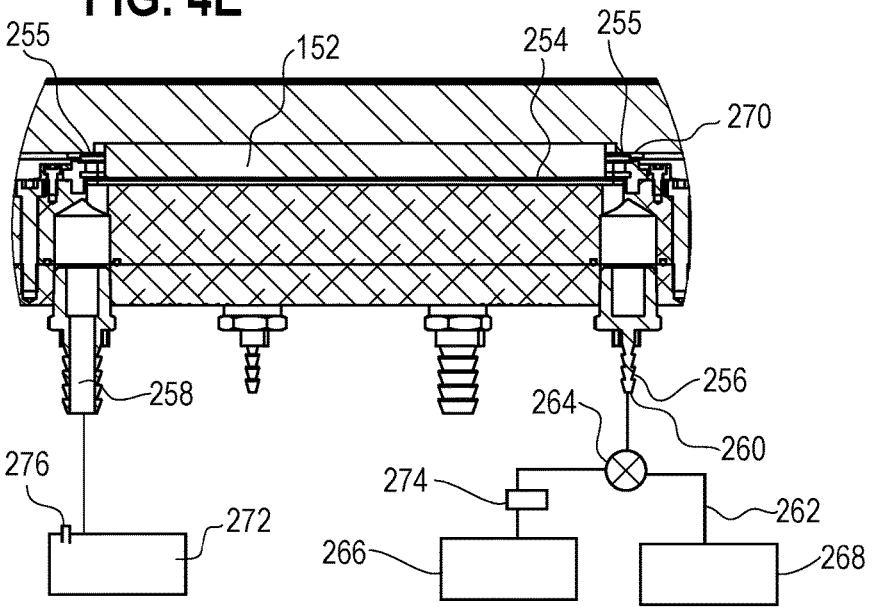
FIG. 4E is an enlarged, fragmentary view of the region indicated by the line 4E-4E of FIG. 4B combined with a block diagram of components of the printhead maintenance unit of FIGS. 2A-2G.
Figure 4F:
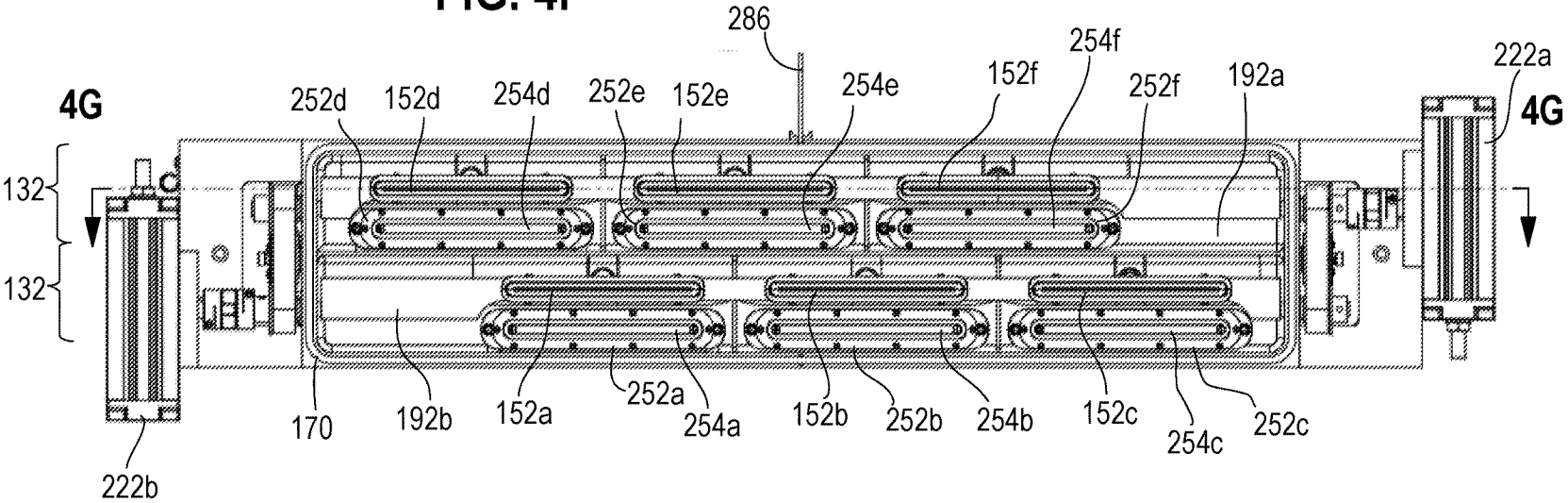
FIG. 4F is a top plan view of the printhead maintenance station of FIGS. 2A-2G with wipers in an extended position.
Figure 4G:
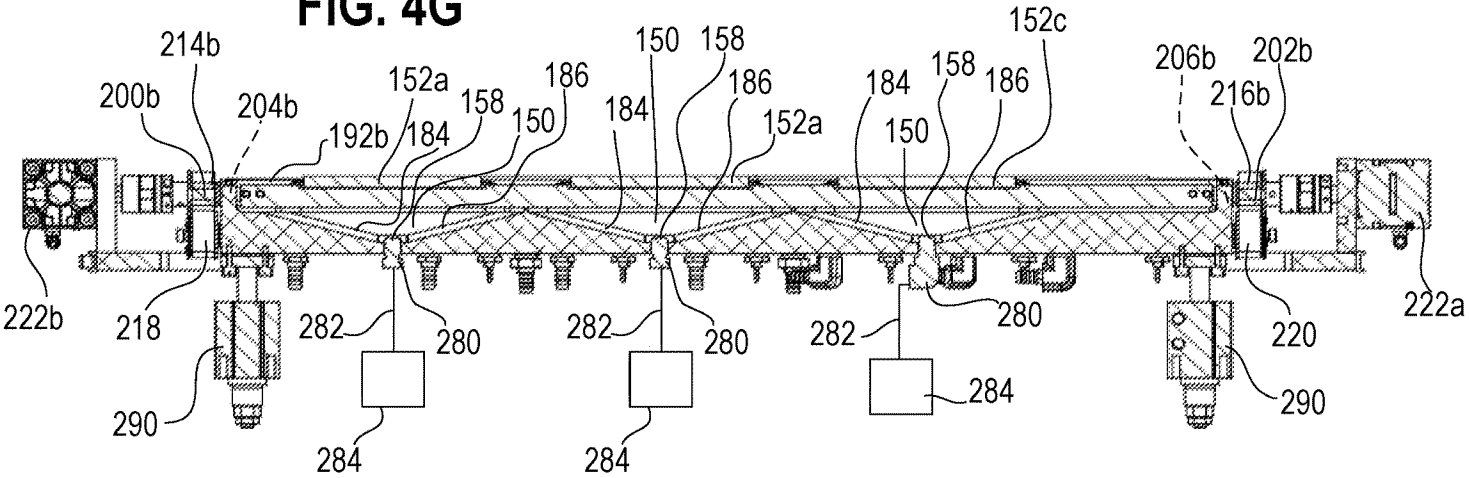
FIG. 4G is a cross-sectional view taken generally along the lines 4G-4G of FIG. 4F.

Referring to FIGS. 4A through 4G, in the illustrated embodiment, each maintenance section 132 of the printhead maintenance station 130 includes a rotatable wiper bar 192 disposed on a top portion of the housing 154 of the printhead maintenance station 130. As shown in FIG. 4D, in one embodiment a rear or anchor member 194 of each wiper 152 may be secured to the wiper bar 192 in any suitable fashion. For example, each anchor member 194 is retained with an anchor recess 195 defined by base and side surfaces 196 and 197 respectively, and inwardly extending flanges 198 and 199 that interfere with the removal of the anchor member 192 from the anchor recess 195, but permit the anchor member 194 to move along a longitudinal axis to permit initial installation and subsequent replacement of the wiper 152. In another embodiment, the wiper 152 may not include the extending flanges 198 and 199, and instead a retaining member 300 holds the wiper 152 in place. In such embodiments, the wiper 152 may be replaced by removing the retaining member 300.

Continuing to refer to FIGS. 4A and 4B, a first wiper bar 192*a* is journaled at opposite ends 200*a* and 202*a* and in bores 204*a* and 206*a*, respectively, of end walls 208 and 210 of the housing 154. A second wiper 192*b* is offset from the first wiper bar 192*a* and is journaled at opposite ends at 200*b* and 202*b* thereof in bores 204*b* and 206*b*, respectively, of the end walls 208 and 210. First and second pulleys 214*a* and 216*a* are secured to the ends 200*a* and 202*a* of the first wiper bar 192*a* adjacent the end walls 208 and 210, respectively. Third and fourth pulleys 214*b* and 216*b* are secured to the ends 200*b* and 202*b* of the second wiper bar 192*b* adjacent and outside the end walls 208 and 210, respectively. First and second belts 218 and 220 extend about the first and third pulleys 214*a* and 214*b* and about the second and fourth pulleys 216*a* and 216*b*, respectively.

A first actuator 222*a* has a drive shaft 224*a* coupled to the first wiper bar 192*a* adjacent the first end wall 210. A second actuator 222*b* includes a drive shaft 224*b* coupled to the second wiper bar 192*b* adjacent to the second end wall 208. The actuators 222*a* and 222*b* synchronously drive the first and second wiper bars 192*a* and 192*b*, respectively, in opposite directions toward the extended and retracted positions. The belts 218 and 220 transmit the torque developed by each actuator 222*a* and 222*b* to both wiper bars 192*a* and 192*b*.

The first actuator 222*a* and the second actuators 222*b* may be, for example, motors, air cylinders, or other devices operable to rotate the first wiper bar 192*a* and second wiper bar 192*b*, respectively. In a preferred embodiment, the actuators 222*a* and 222*b* may be pneumatic motors or air cylinders. However, it should be apparent to one of ordinary skill that other types of motors may be used including different fluidic motors or induction motors of any suitable type, such as an induction motor, a direct current motor, a stepper motor, and the like.

In some embodiments, the wiper bars 192 of the maintenance sections 132 of the printhead maintenance station 130 are moved in a direction perpendicular to a longitudinal axis of the wiper 152 approximately 180 degrees between the extended (i.e., wiping) position and the cleaning and storage (i.e., retracted) position.

Referring to FIGS. 4A-4E, secured to an interior bottom surface 250 of the housing 154 are one or more wiper cleaning assemblies 252. In the illustrated embodiment, one wiper cleaning assembly 252*a*, 252*b*, . . . , 252*f* is associated with each wiper 152*a*, 152*b*, . . . , 152*f* of the printhead maintenance station 130. In other embodiments, a plurality of wipers 152 may share one wiper cleaning assembly 252. In still other embodiments, one wiper cleaning assembly 252 may be shared by all of the wipers 152 associated with each maintenance section 132.

Each wiper cleaning assembly 252*a*, 252*b*, . . . , and 252*f* includes a chamber 254*a*, 254*b*, . . . , and 254*f*, respectively, into which the wiper 152*a*, 152*b*, . . . , and 152*f* associated with such cleaning assembly may be retracted for cleaning and storage. The controller 112 (see FIG. 1) operates the actuators 222 to rotate the wiper bars 192 until each wiper 152 secured to such wiper bars 192 is disposed in the chamber 254 of the wiper cleaning assembly 252 associated with such wiper 152.

Each chamber 254 includes a fluid intake port 256 and fluid purge port 258. An input end 260 of the fluid intake port 256 is coupled to a fluid supply line 262. The fluid supply line 262 is coupled via a three-way valve 264 to a cleaning fluid supply 266 and a pressurized gas supply 268. An output end 270 of the fluid intake port 256 is in fluid communication with the chamber 254 so that any fluid introduced into the fluid intake port 256 is deposited into such chamber 254.

In the illustrated embodiment, the fluid purge port 258 of each chamber 254 is coupled to a waste tank 272. In some embodiments, one waste tank 272 may be coupled to each fluid purge port 258. In other embodiments, one waste tank 272 may be coupled to a plurality of fluid purge ports 258 and/or multiple waste tanks 272 may be coupled to one or more fluid purge ports 258.

To clean the wipers 152, for example, after such wipers 152 have been used to wipe the nozzle plate 156 as described above in connection with FIGS. 2A-2G, the controller 112 (FIG. 1) operates the actuators 222 to rotate the wiper bars 192 until the wipers 152 secured to such wiper bars 192 are disposed in the chambers 254.

To prevent the cleaning fluid and/or the pressurized gas introduced in the chambers 254 from escaping into the housing 154, a gasket 255 may surround each wiper 152 and/or the blade holder 300 which secures the wiper 152. When the wiper 152 is disposed in the chamber 254, the gasket 255 may form a seal that isolates the chamber 254 and the wiper 152 from the rest of the housing 154. In some embodiments, the gasket 255 or another gasket may be disposed around the opening of the chamber 254 to provide such seal.

After the wiper 152 is disposed in the chamber 254, the controller 112 actuates the three-way valve 264 so that the fluid supply line 262 is coupled to the cleaning fluid supply 266. The controller 112 then actuates a pump 274 to force cleaning fluid from the cleaning fluid supply 266 into the fluid supply line 262, through the fluid intake port 256, and into the chamber 254. As the chamber 254 fills with the cleaning supply fluid the cleaning fluid flows across the wiper 152 and into the fluid purge port 258. Such flow of cleaning fluid dislodges any ink and debris on the wiper 152 and carries such ink and/or debris therewith through the fluid purge port 258 and into the waste tank 272.

After the cleaning fluid is forced past the wipers 152 for a predetermined amount of time, the controller 112 operates the three-way valve 264 to couple the fluid supply line 262 to the pressurized gas supply 268 to introduce pressurized gas into the chamber 254. The pressurized gas in the chamber 254 flows past the wiper 152 and exits the chamber 254 through the fluid purge port 258. The flow of pressurized gas carries any cleaning fluid in the chamber 254 and/or on the wiper 152 and dries the chamber 254 and/or the wiper 152. In some embodiments, the waste tank 272 may include a port 276 open to the environment through which the pressurized gas may be released. The port 276 may include a filter that traps fluids and/or particles.

After allowing the pressurized gas to flow through the chamber 254 for a predetermined amount of time, the controller 112 closes the three-way valve 264. The wipers 152 may remain in the chambers 254 until the wipers 152 are needed to wipe the nozzle plates 156, although the wipers may be moved to the extended position at any time.

Referring to FIG. 4A through FIG. 4G, the drain 158 in each catch trough 150 is coupled to a fluid line connector 280. The fluid line connector 280 is coupled via a fluid line 282 to a fluid recovery tank 284. As described above, ink or other fluid purged form the printhead 106 may be deposited on the first sloping sidewall 184 and the second sloping sidewall 186 and flow into the drain 158. Such ink or other fluid(s) flow through the drain 158, the fluid line connector 280, the fluid line 282, and into the fluid recovery tank 284. In some embodiments, ink or other fluid purged from each printhead 106 is transferred to a particular fluid recovery tank 284 coupled to the catch trough 150 associated with such printhead 106. This allows the different inks or other fluids purged from the printheads 106 to be collected separately, and recycled or disposed of appropriately. In other embodiments, ink or other fluid purged from a plurality of printheads 106 may be directed to the same fluid recovery tank 284.

It should be apparent that one or more filters may be disposed in one or both of the fluid line 262 or 282 to trap any contaminants in the fluids that flow therethrough.

Referring to FIG. 4A, in some embodiments a gas tube 286 is coupled to the inflatable gasket 170. The controller 112 may operate a gas supply (not shown) to supply gas through the gas tube 286 and into the inflatable gasket 170 to inflate the inflatable gasket 170 as described above in connection with FIG. 2G.

Referring to FIGS. 4B and 4G, one or more pneumatic lifters 290 are secured to the housing 154 of the printhead maintenance station 130. As shown in FIG. 4G, the controller 112 operates such lifters 290 to raise the printhead maintenance station 130 toward the print unit 102 as described in connection with FIG. 2D. As shown in FIG. 4B, the controller 112 operates such lifters 290 to lower the printhead maintenance station 130 away from the print unit 102 as described in connection with FIG. 2F.

Figure 5:
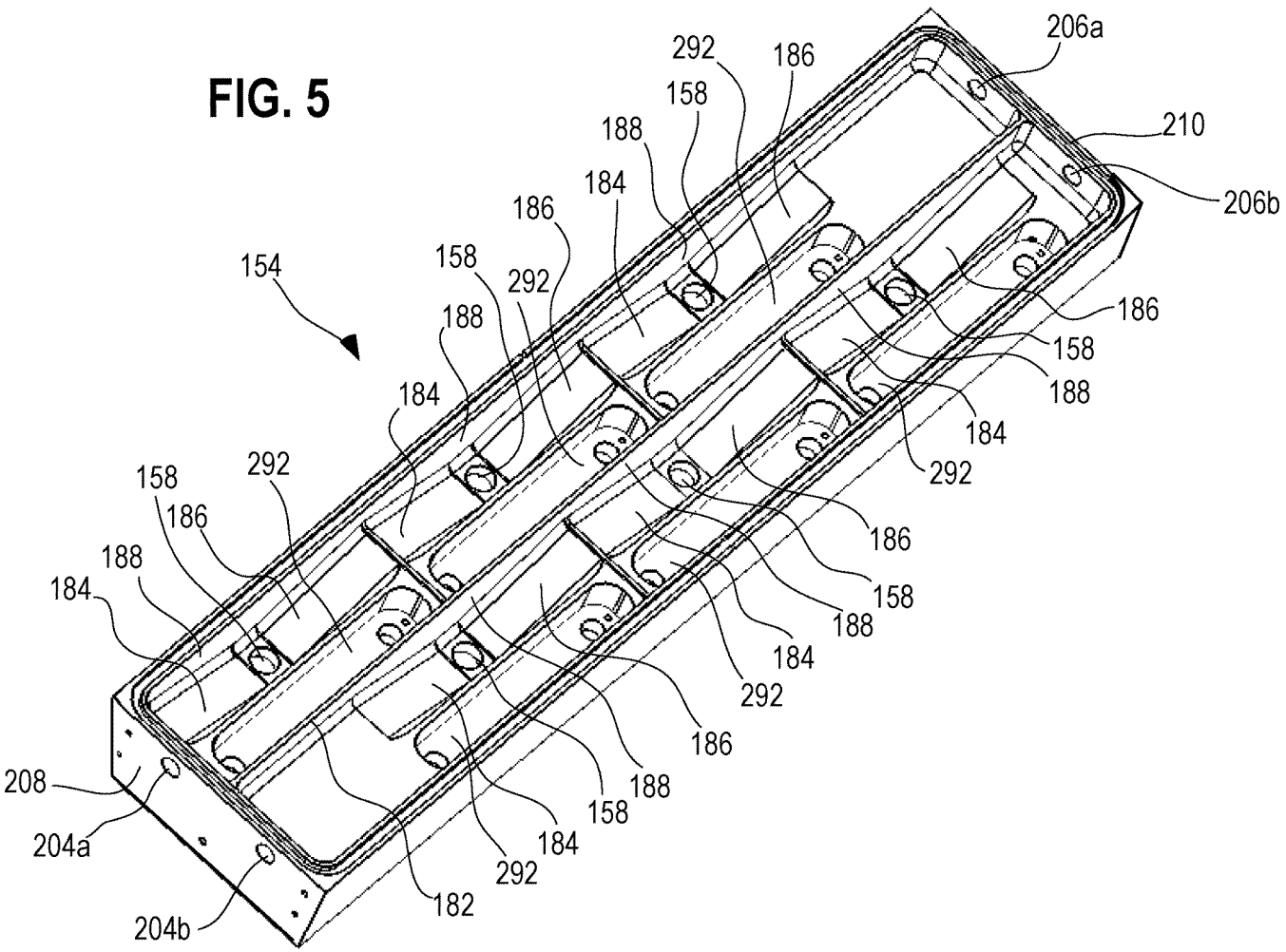
FIG. 5 is an isometric view of a housing of the printhead maintenance unit of FIGS. 2A-2G.

Referring to FIG. 5, in one embodiment the housing 154 is manufactured from a solid block of material such as a metal, fiberglass, and the like. The housing 154 may be milled or otherwise processed to define the sidewalls 184, 186 and drains 158 of the catch troughs 150, and receptacles 292 into which the wiper cleaning assemblies 252 may be disposed. The bores 204 and 206 may also be drilled into the first and second end walls 208 and 210 of the housing 154 through which the ends 200 and 202, respectively, of the wiper bars 192 may pass.

INDUSTRIAL APPLICABILITY

Numerous modifications to the present embodiments will be apparent to those skilled in the art in view of the foregoing description. Accordingly, this description is to be construed as illustrative only and is presented for the purpose of enabling those skilled in the art to make and use the embodiments and to teach the best mode of carrying out same. The exclusive rights to all modifications which come within the scope of the appended claims are reserved.

What is claimed is:

1. A printhead maintenance station for cleaning a nozzle plate of a print unit that is movable parallel to a first axis and a second axis, comprising:

a wiper bar having a wiper secured thereto;

a wiper cleaning assembly associated with the wiper, wherein the wiper is movable from a stored position in which the wiper is stored in the wiper cleaning assembly and a wiping position spaced apart from the stored position;

an actuator; and a controller adapted to move a print medium, the printhead maintenance station, and the print unit parallel to the first axis;

wherein the printhead maintenance station is adapted to remain stationary when the print unit moves parallel to the second axis and, when not in use, the wiper is disposed at the stored position, and wherein during a maintenance cycle, the controller is adapted to operate the actuator to move the wiper bar to move the wiper from the stored position to the wiping position, and cause relative movement of the printhead maintenance station and the print unit to wipe the nozzle plate with the wiper.

2. The printhead maintenance station of claim 1, including a trough having a drain, wherein the controller positions the printhead relative to the trough so that fluid ejected from the printhead is directed toward the drain.

3. The printhead maintenance station of claim 2, wherein the trough includes a sloping sidewall and the fluid ejected from the printhead onto the sloping sidewall flows toward the drain.

4. The printhead maintenance station of claim 3, wherein the drain is coupled to a waste collection tank and fluid ejected from the printhead is collected in the waste collection tank.

5. The printhead maintenance station of claim 1, including a further wiper bar having a further wiper secured thereto, wherein the further wiper bar is coupled to the wiper bar such that the wiper bar and the further wiper bar rotate in synchrony.

6. The printhead maintenance station of claim 5, including a belt that couples the wiper bar and the further wiper bar.

7. The printhead maintenance station of claim 5, wherein a drive shaft of the actuator is coupled to the wiper bar, a drive shaft of a further actuator is coupled to the further wiper bar, and torque from both the first actuator and the further actuator is transferred to both the wiper bar and the further wiper bar.

8. The printhead maintenance station of claim 1, wherein the wiper cleaning assembly includes a fluid intake port coupled to a source of cleaning fluid, a fluid purge port, and a wiper chamber, wherein the cleaning fluid is introduced into the wiper chamber through the fluid intake port, passes across a face of the wiper disposed in the wiper chamber, and exits the wiper chamber through the fluid purge port, thereby cleaning the face of the wiper.

9. The printhead maintenance station of claim 8, wherein the fluid intake port is further coupled to a source of gas, and the gas is introduced into the wiper chamber through the fluid intake port to dry the face of the wiper disposed in the wiper chamber.

10. The printhead maintenance station of claim 1, including a gasket that seals a nozzle plate of the printhead in a space formed by the print unit, the gasket, and the printhead maintenance station.

11. The printhead maintenance station of claim 1, including a housing and the cleaning assembly is secured to an interior bottom surface of the housing.

12. The printhead maintenance station of the claim 11, wherein the housing includes first and second opposite sidewalls, and the wiper bar is journaled at first and second opposite ends thereof in first and second bores in the first and second sidewalls, respectively.

13. A method of operating a printhead maintenance station to clean a nozzle plate of a print unit that is movable parallel to a first axis and a second axis, wherein the printhead maintenance station includes a wiper bar, a wiper secured to the wiper bar, and a wiper cleaning assembly, the wiper being movable from a stored position in which the wiper is stored in the wiper cleaning assembly and a wiping position spaced apart from the stored position, comprising:

disposing the wiper at the stored position;

operating an actuator to move the wiper bar to move the wiper from the stored position to the wiping position;

moving a print medium, the printhead maintenance station, and the print unit parallel to the first axis;

keeping the printhead maintenance station stationary when the print unit moves parallel to the second axis; and moving the print unit relative to the printhead maintenance station, thereby wiping the nozzle plate with the wiper.

14. The method of claim 13, including the further step of positioning the printhead relative to a trough so that fluid ejected from the printhead is directed toward a drain disposed in the trough.

15. The method of claim 14, including the further steps of coupling the drain to a waste collection tank and collecting the fluid ejected from the printhead in the waste collection tank.

16. The method of claim 13, including the further steps of providing a further wiper bar having a further wiper secured thereto, coupling the further wiper bar and the wiper bar, and rotating the wiper bar and the further bar in synchrony.

17. The method of claim 16, wherein the step of coupling the further wiper bar and the wiper bar includes the step of coupling the wiper bar and the further wiper bar with a belt.

18. The method of claim 13, including the further steps of coupling a drive shaft of the actuator to the wiper bar, coupling a drive shaft of a further actuator to the further wiper bar, and transferring torque from both the first actuator and the further actuator to both the wiper bar and the further wiper bar.

19. The method of claim 13, including the further step of introducing a cleaning fluid into a chamber of the wiper cleaning assembly such that the cleaning fluid passes across a face of the wiper disposed in the chamber and exits the chamber, thereby cleaning the face of the wiper.

20. The method of claim 19, including the further step of introducing into the chamber a gas to dry the face of the wiper disposed in the wiper chamber.

21. The method of claim 20, including the further step of disposing a gasket, wherein the gasket seals a nozzle plate of the printhead in a space formed by the print unit, the gasket, and the printhead maintenance station.

* * * * *